US012196467B2

(12) United States Patent
Miura et al.

(10) Patent No.: US 12,196,467 B2
(45) Date of Patent: Jan. 14, 2025

(54) AIR CONDITIONING DEVICE

(71) Applicant: Carrier Japan Corporation, Tokyo (JP)

(72) Inventors: Ken Miura, Fuji (JP); Hiromasa Yamane, Fuji (JP)

(73) Assignee: Carrier Japan Corporation, Tokyo (JP)

( * ) Notice: Subject to any disclaimer, the term of this patent is extended or adjusted under 35 U.S.C. 154(b) by 492 days.

(21) Appl. No.: 17/497,620

(22) Filed: Oct. 8, 2021

(65) Prior Publication Data

US 2022/0026126 A1 Jan. 27, 2022

Related U.S. Application Data

(63) Continuation of application No. PCT/JP2019/015518, filed on Apr. 9, 2019.

(51) Int. Cl.
*F25B 47/02* (2006.01)

(52) U.S. Cl.
CPC ..... *F25B 47/02* (2013.01); *F25B 2347/02* (2013.01); *F25B 2700/11* (2013.01)

(58) Field of Classification Search
CPC ..... F25B 47/02; F25B 2313/0211; F25B 2313/02322; F25B 2313/02332; F25B 2313/02342; F25B 2313/0251; F25B 2313/02522; F25B 2313/02532; F25B 2313/02542; F25B 2347/02; F25B 2347/021; F25B 2347/022; F25B 2347/023; F25B 2313/0315; F25B 2700/11

See application file for complete search history.

(56) References Cited

U.S. PATENT DOCUMENTS

| | | | | |
|---|---|---|---|---|
| 2010/0125370 | A1 | 5/2010 | Baba et al. | |
| 2017/0130997 | A1 * | 5/2017 | Honda | F25B 13/00 |
| 2019/0032978 | A1 * | 1/2019 | Ohura | F25B 47/02 |
| 2019/0203994 | A1 * | 7/2019 | Nakagawa | F25B 47/02 |

FOREIGN PATENT DOCUMENTS

| | | | |
|---|---|---|---|
| CN | 101435638 | A | 5/2009 |
| CN | 101737867 | A | 6/2010 |
| CN | 103906984 | A | 7/2014 |
| EP | 2187141 | A2 | 5/2010 |
| EP | 2515053 | A2 | 10/2012 |
| EP | 2784414 | A1 | 10/2014 |
| JP | 2002286273 | A | 10/2002 |

(Continued)

OTHER PUBLICATIONS

Chinese Office Action mailed on Aug. 3, 2022 for Chinese Patent Application No. 201980095237.3, 16 pages.

(Continued)

*Primary Examiner* — Frantz F Jules
*Assistant Examiner* — Webeshet Mengesha
(74) *Attorney, Agent, or Firm* — Lee & Hayes, P.C.

(57) ABSTRACT

According to one embodiment, it preferentially executes, if the starting conditions for defrosting of each air conditioner are met chronologically close to each other, the defrosting operation with respect to the air conditioner starting condition for defrosting of which is earliest among the air conditioners without waiting for a time when the starting condition for defrosting thereof is met.

5 Claims, 8 Drawing Sheets

(56) References Cited

FOREIGN PATENT DOCUMENTS

| | | | |
|---|---|---|---|
| JP | 200590784 | A | 4/2005 |
| JP | 2010121798 | A | 6/2010 |
| JP | 4667496 | B2 | 4/2011 |
| JP | WO2013077167 | A1 | 5/2013 |
| JP | 2013108732 | A | 6/2013 |
| KR | 20140066773 | A | 6/2014 |
| WO | WO2018042611 | A1 | 3/2018 |
| WO | WO2020208723 | A1 | 10/2020 |

OTHER PUBLICATIONS

Extended European Search Report mailed on Oct. 14, 2022, for EP Application No. 19924067.2, 7 pages.

* cited by examiner

AIR CONDITIONING DEVICE

CROSS-REFERENCE TO RELATED APPLICATIONS

This application is a Continuation Application of PCT Application No. PCT/JP2019/015518, filed Apr. 9, 2019, the entire contents of which are incorporated herein by reference.

FIELD

Embodiments described herein relate generally to an air conditioning apparatus with a plurality of air conditioners.

BACKGROUND

There are air conditioners with a heat pump refrigeration cycle in which a compressor, four-way valve, outdoor heat exchanger, reducing-unit, indoor heat exchanger are connected orderly to cycle the refrigerant, in order to heat the indoor air by absorbing the heat from the outside air, and during the heating operation, the surface of the outdoor heat exchanger which functions as an evaporator is gradually frosted, and the heating performance will be deteriorated when the frost amount increases to an extent to decrease the heat absorption from the outside air.

As a countermeasure, the air conditioners execute a defrosting operation by monitoring the frosting condition of the outdoor heat exchanger based on a temperature or the like of the outdoor heat exchanger, directly supplying output refrigerant (high temperature refrigerant) of the compressor to the outdoor heat exchanger when the frost increases, and defrosting the outdoor heat exchanger with the heat from the high temperature refrigerant.

If an air conditioning apparatus with a plurality of air conditioners performs air conditioning of the same area, the air conditioners may be stopped altogether at the same time to transit to the defrosting operation, and thus, the room temperature of the area may be greatly decreased, and residents may feel uncomfortable.

The purpose of the present application presents an air conditioning apparatus which suppresses the decrease of the room temperature by defrosting as much as possible.

DETAILED DESCRIPTION

In general, according to one embodiment, an air conditioning apparatus of claim 1 includes: a plurality of air conditioners with a heat pump refrigeration cycle in which a compressor, a four-way valve, an outdoor heat exchanger, a reducing-unit, and an indoor heat exchanger are connected, the air conditioners configured to execute a defrosting operation with respect to the outdoor heat exchanger if a starting condition for defrosting is met; and controller which executes, if the starting conditions for defrosting of each air conditioner are met chronologically close to each other, the defrosting operation with respect to the air conditioner starting condition for defrosting of which is earliest among the air conditioners without waiting for a time when the starting condition for defrosting thereof is met.

[1] First Embodiment of Present Application

Figure 1:
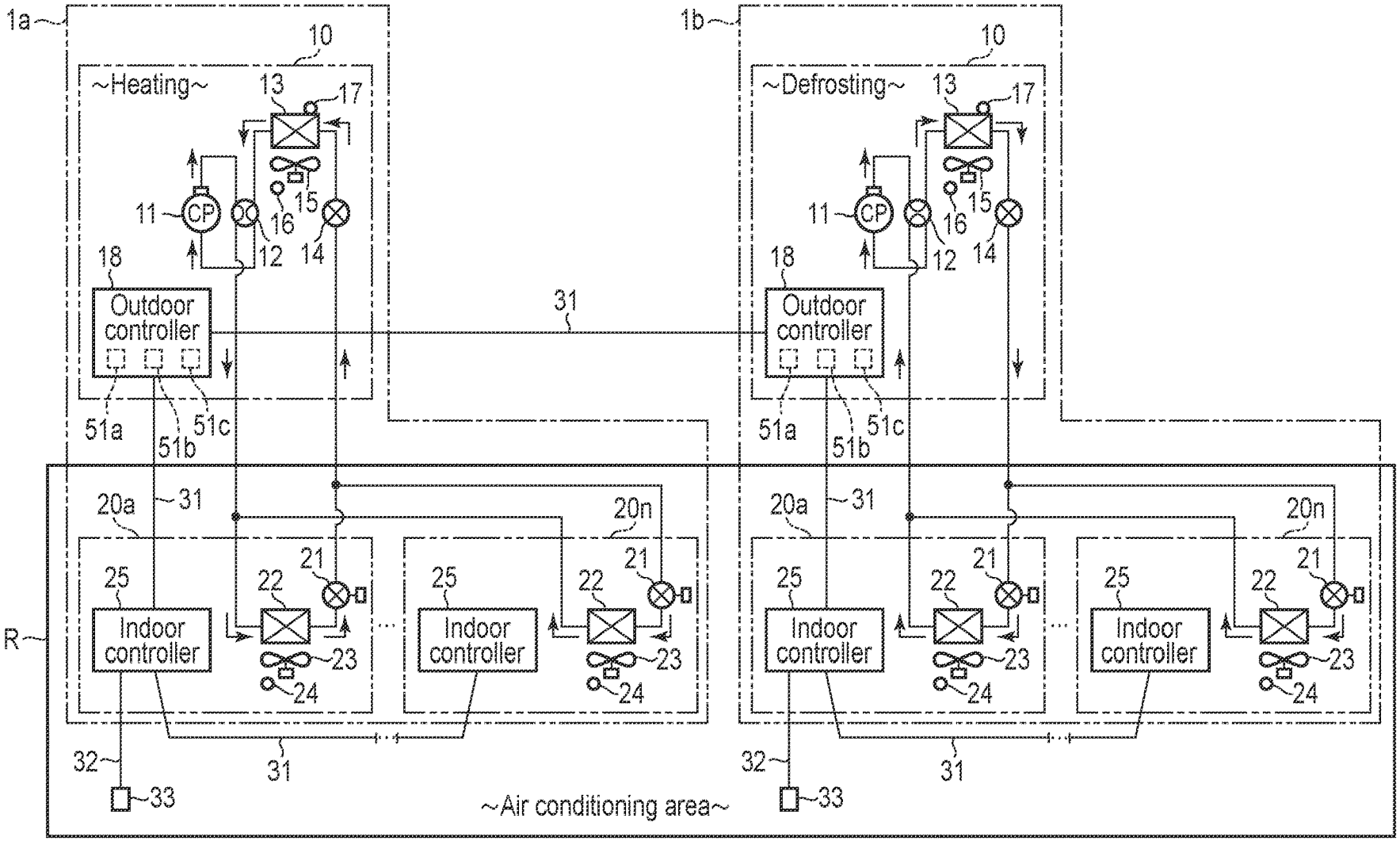
FIG. 1 illustrates the structure of a first embodiment.

As in FIG. 1, a plurality of, for example, two air conditioners 1*a* and 1*b* of an air conditioning apparatus are located in an air conditioning area R. The air conditioner 1*a* includes at least one outdoor unit 10 and a plurality of indoor units 20*a* to 20*n*, and the air conditioner 1*b* includes at least one outdoor unit 10 and a plurality of indoor units 20*a* to 20*n*.

The air conditioner 1*a* includes a heat pump refrigeration cycle in which a compressor 11, four-way valve 12, outdoor heat exchanger 13, expansion valve 14, multiple flow adjusting valves 21, and multiple indoor heat exchangers 22 are connected. In a cooling operation, the refrigerant output from the compressor 11 passes through the four-way valve 12 into the outdoor heat exchanger (condenser) 13, and the refrigerant flowing from the outdoor heat exchanger 13 passes through the expansion valve 14 and each flow adjusting valve 21 into each indoor heat exchanger (evaporator) 22, and the refrigerant flowing from each indoor heat exchanger 22 passes through the four-way valve 12 to be absorbed by the compressor 11. In a heating operation, with switching of the path of the four-way valve 12 as shown with an arrow in the depiction of the air conditioner 1*a*, the refrigerant output from the compressor 11 passes through the four-way valve 12 into each indoor heat exchanger (condenser) 22, and the refrigerant flowing from each indoor heat exchanger 22 passes through each flow adjusting valve 21 and the expansion valve 14 into the outdoor heat exchanger (evaporator) 13, and the refrigerant flowing from the outdoor heat exchanger 13 passes through the four-way valve 12 to be absorbed by the compressor 11.

In the heating operation, a defrosting operation with respect to the outdoor heat exchanger 13 is performed periodically or if need be. In the defrosting operation, the path of the four-way valve 12 returns to its original position as shown with an arrow in the depiction of the air conditioner 1*b* such that the refrigerant flows in the same direction as that in the cooling operation.

An outdoor fan 15 which intakes outside air through the outdoor heat exchanger 13 is placed in the proximity of the outdoor heat exchanger 13, and an outdoor temperature sensor 16 which detects an outside air temperature To is placed in an intake path of the outdoor fan 15, and a heat exchange temperature sensor 17 which detects a heat exchanger temperature Te is attached to the outdoor heat exchanger 13. Each indoor fan 23 which absorbs inside air in the air conditioning area R to pass the air to each indoor heat exchanger 22 is placed in the proximity of each indoor heat exchanger 22, and each indoor temperature sensor 24 which detects a temperature of room air (room temperature) Ta is placed in an intake path of each indoor fan 23.

An outdoor controller 18 which primarily controls the air conditioner 1*a* is accommodated in the outdoor unit 10 together with the compressor 11, four-way valve 12, outdoor heat exchanger 13, expansion valve 14, outdoor fan 15, outdoor temperature sensor 16, and heat exchange temperature sensor 17. An indoor controller 15 is accommodated in each of the indoor units 20*a* to 20*n* together with the flow adjusting valve 21, each indoor heat exchanger 22, each indoor fan 22, and each indoor temperature sensor 24.

The outdoor controller 18 of the outdoor unit 10 and the indoor controller 25 of the indoor unit 20*a* are connected through a control and data transfer bus line 31, and the indoor controller 25 of the indoor unit 20*a* and each of the indoor controllers 25 of the indoor units 20*b* to 20*n* are connected through the bus line 31. Then, a remote controlled control unit (remote controller) 33 for controlling operations and setting operation conditions is connected to the indoor controller 25 of the indoor unit 20*a* with a power-voltage synchronized serial signal line 32. The remote controller 33 is attached to a wall surface of the air conditioning area, by which users can control the units easily.

The outdoor controller 18 of the outdoor unit 10 includes a microcomputer and peripheral circuits thereof, and performs communication with each of the indoor controllers 25 of the indoor units 20*a* to 20*n* through the bus line 31 periodically or if need be while controlling the performance of the compressor 11, path change of the four-way valve 12, degree of opening of the expansion valve 14, and operation of the outdoor fan 15 based on commands, transfer data, and the like from each indoor controller 25. That is, the outdoor controller 18 controls the performance (operation frequency F) of the compressor 11 based on a sum of required performances of the indoor units 20*a* to 20*n* measured based on a difference between a detected temperature of each indoor temperature sensor 24 and a setting temperature of the remote controller 33 in the cooling and heating operations. Specifically, the outdoor controller 18 preliminarily stores a starting condition for defrosting with respect to the outdoor heat exchanger 13 of the air conditioner 1*a*, and executes a defrosting operation with respect to the outdoor heat exchanger 13 if the starting condition for defrosting is met during the heating operation. The starting condition for defrosting will be met each time when a continuation time t of the heating operation of the air conditioner 1*a* reaches a predetermined time ta, for example.

An outdoor unit 10 and indoor units 20*a* to 20*n* of the air conditioner 1*b* are structured the same as those of the air conditioner 1*a*. Outdoor controllers 18 of the air conditioners 1*a* and 1*b* are connected through the aforementioned control and data transfer bus line 31. The outdoor controllers 18 of the air conditioners 1*a* and 1*b* communicate with each other through the bus line 31 to execute the defrosting operation in cooperation. That is, if the times when the starting condition for defrosting is met are chronologically close to each other between the outdoor controllers 18 of the conditioners 1*a* and 1*b*, that is, specifically, if the times when the starting condition for defrosting therebetween is met are so close to be within a range of a certain time Δt, the air conditioner whose starting condition for defrosting is earlier immediately preferentially executes the defrosting operation without waiting for the time when the starting condition for defrosting thereof is met. Note that, if the times when the starting condition for defrosting is met are the same between the outdoor controllers 18 of the air conditioners 1*a* and 1*b*, the air conditioner which has preliminarily been prioritized higher immediately preferentially executes the defrosting operation without waiting for the time when the starting condition for defrosting thereof is met.

In order to achieve the above controlling, each of the outdoor controllers 18 of the air conditioners 1*a* and 1*b* includes the following control section (first to third control means) 51*a* to 51*c* as main functions thereof.

The control section 51*a* sends, if the continuation time t of the heating operation reaches a setting time which is before the predetermined time ta, which is the required element for the starting condition for defrosting, by a certain time Δt (=ta−Δt), a pre-defrosting signal X of logic "1" indicating that the starting condition for defrosting is soon to be met in the air conditioner to other air conditioners. The certain time Δt is equal to or greater than the time td required for the defrosting operation of the air conditioner. The time td required for the defrosting operation is a time when the defrosting operation is completed in any environment, and a suitable time which has been calculated based on experiments and the like is selected. The predetermined time to is, for example, sixty minutes, and the certain time Δt is, for example, ten minutes.

The control section 51*b* immediately preferentially executes, if a rising part of the pre-defrosting signal X is received from all of the other air conditioners during a period when the sending of the pre-defrosting signal X is started until the starting condition for defrosting is met (=a certain time Δt), the defrosting operation of the air conditioner without waiting for a time when the starting condition for defrosting of the air conditioner is met. Note that, if the time to start the sending of the pre-defrosting signal X and the time to receive a rising part of the pre-defrosting signal X sent from other air conditioners are the same, the control section 51*b* immediately executes the defrosting operation of the air conditioner without waiting for the time when the starting condition for defrosting of the air conditioner is met if the priority of the air conditioner is higher than that of the other air conditioners.

The control section 51*c* executes, if a rising part of the pre-defrosting signal X is not received from all of the other air conditioners during a period when the sending of the pre-defrosting signal X is started until the starting condition for defrosting is met (=a certain time Δt), the defrosting operation of the air conditioner if the starting condition for defrosting of the air conditioner is met.

Figure 2:
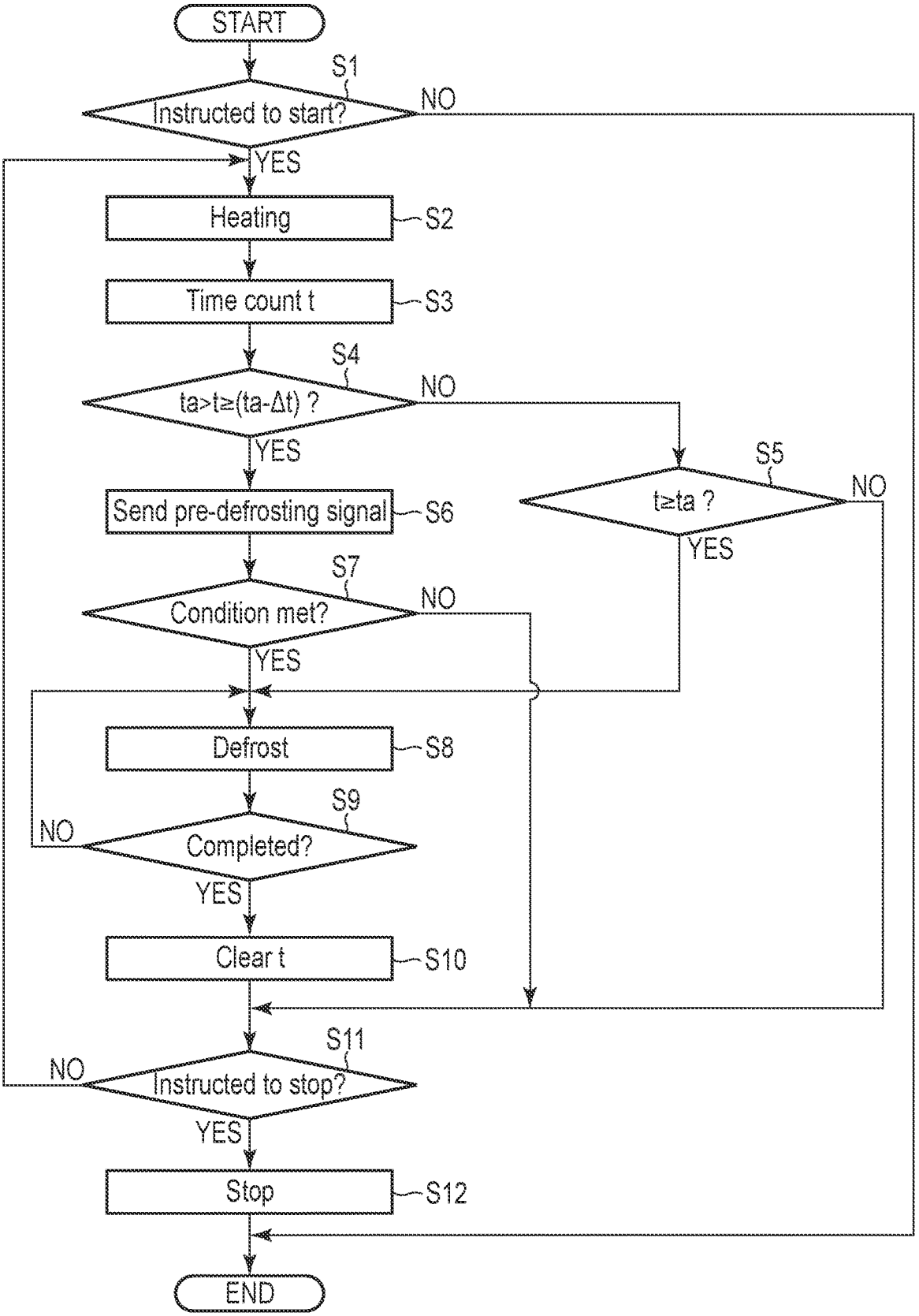
FIG. 2 is a flowchart of controlling of each air conditioner of the first embodiment.

Now, the control executed by each outdoor controller 18 of the air conditioners 1*a* and 1*b* will be explained as the controlling of the air conditioners 1*a* and 1*b*, with reference to flowchart of FIG. 2 and time chart FIG. 3. Steps S1, S2, . . . , and the like will be referred to as S1, S2, . . . , and the like. Defrost time "ON" in the time charts indicates a time when the starting condition for defrosting is met.

If the heating operation is started by the remote controller 33 (YES in S1), the air conditioners 1*a* and 1*b* execute the heating operation (S2), and execute a time count t to measure a continuation time t of each heating operation (S3). Then, the air conditioners 1*a* and 1*b* determine whether or not the time count t is within a range which is equal to or greater than a setting time (=ta-Δt) and below a predetermined time ta (S4). If the result of determination is denied (NO in S4), the air conditioners 1*a* and 1*b* determine whether or not the time count t is equal to or greater than the predetermined time ta (S5). If the result of determination is denied (NO in S5), the air conditioners 1*a* and 1*b* transit to determination of stop instruction in S11 performed later.

If the time count t reaches the setting time (=ta−Δt) (YES in S4), the air conditioners 1*a* and 1*b* send a pre-defrosting signal X of logic "1" indicating that the starting condition for defrosting is soon to be met during a period until the starting condition for defrosting of the air conditioner is met (=a certain time Δt) to the other air conditioner (S6). Then, the air conditioners 1*a* and 1*b* start the sending of the pre-defrosting signal X, and then, monitor if a priority condition to receive a rising part of the pre-defrosting signal X of the other air conditioner is met during a period until the starting condition for defrosting of each air conditioner is met (=a certain time Δt) (S7). The rising part of the pre-defrosting signal X corresponds to a time when the starting condition for defrosting is met.

Figure 3:
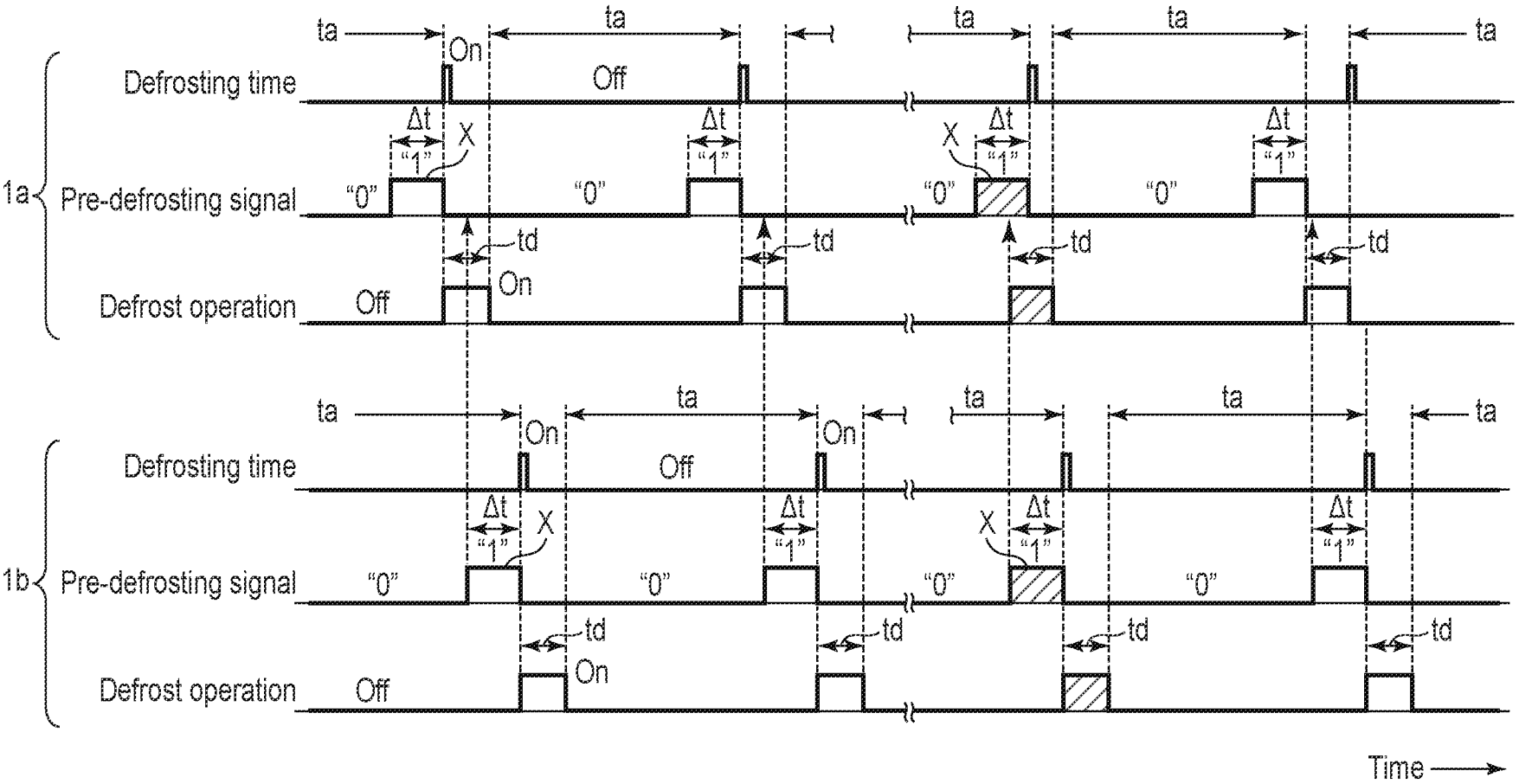
FIG. 3 is a time chart of operation of each air conditioner of the first embodiment.

In FIG. 3, the first time when the starting condition for defrosting of the air conditioner 1*a* is met (defrost time "ON") is earlier than the first time when the starting condition for defrosting of the air conditioner 1*b* is met, and a time difference between these first times is greater than a certain time Δt. In that case, the rising part of the pre-defrosting signal X sent from the air conditioner 1*b* does not overlap with the pre-defrosting signal X sent from the air conditioner 1*a*, and the priority condition is not met (NO in S7). If the priority condition is not met (NO in S7), the air conditioner 1*a* transits to the determination of stop instruction in S11 performed later.

In FIG. 3, the third time when the starting condition for defrosting of the air conditioner 1*a* is met is earlier than the third time when the starting condition for defrosting of the air conditioner 1*b* is met, and a time difference between these third times is below a certain time Δt. In that case, the rising part of the pre-defrosting signal (hatched in the figure) X sent from the air conditioner 1*b* overlaps with the pre-defrosting signal (hatched in the figure) X sent from the air conditioner 1*a*, and the priority condition is met (YES in S7).

If the priority condition is met (YES in S7), the air conditioner 1*a* immediately preferentially executes the defrosting operation with respect to the outdoor heat exchanger 13 without waiting for the time when the starting condition for defrosting of the air conditioner 1*a* is met (S8). In accordance with the prioritized execution, the air conditioner 1*a* monitors completion of defrosting in the outdoor heat exchanger 13 based on, for example, a detection temperature Te of the heat exchange temperature sensor 17 (S9). If the defrosting is not completed (NO in S9), the air conditioner 1*a* returns to S8 to continue the defrosting operation (S8).

If the defrosting is completed (YES in S9), the air conditioner 1*a* clears the time count t (S10), and transits to determination of stop instruction in S11. If stop is not instructed (NO in S11), the air conditioner 1*a* returns to S2 to restart heating (to end the defrosting operation), and the time count t restarts from zero (S3). If stop is instructed (YES in S11), the air conditioner 1*a* stops all operations (S12).

While the air conditioner 1*a* is executing the defrosting operation, the priority condition is not met in the air conditioner 1*b* (NO in S7). If stop is not instructed in the air conditioner 1*b* (NO in S11), the time count t reaches the predetermined time ta, and the starting condition for defrosting of the air conditioner 1*b* is met (NO in S4, YES in S5). The air conditioner 1*b* executes the defrosting operation when the starting condition for defrosting thereof is met (S8). Since the defrosting operation of the air conditioner 1*a* has been ended, the defrosting operations of the air conditioners 1*a* and 1*b* do not overlap with each other.

In a case where the air conditioners 1*a* and 1*b* are to perform air conditioning of the same air conditioning area R, when the defrosting operations of the air conditioners 1*a* and 1*b* overlap with each other, the heating operation of each air conditioner is stopped, and the room temperature of the air conditioning area R is greatly decreased, and residents will be displeased. In contrast, in the present embodiment, if the times when the starting condition for defrosting is met in the air conditioners 1*a* and 1*b* are close to each other within the range of a certain time Δt, the defrosting operation of the air conditioner whose starting condition for defrosting is met earlier is immediately performed, and after the completion of the defrosting operation, the defrosting operation of the other air conditioner is performed. Thus, a time when the heating is stopped in the air conditioner 1*a* because of the defrosting operation thereof and a time when the heating is stopped in the air conditioner 1*b* because of the defrosting operation thereof do not overlap with each other. Therefore, a decreased of room temperature in the air conditioning area R can be suppressed.

[2] Second Embodiment of Present Application

Figure 4:
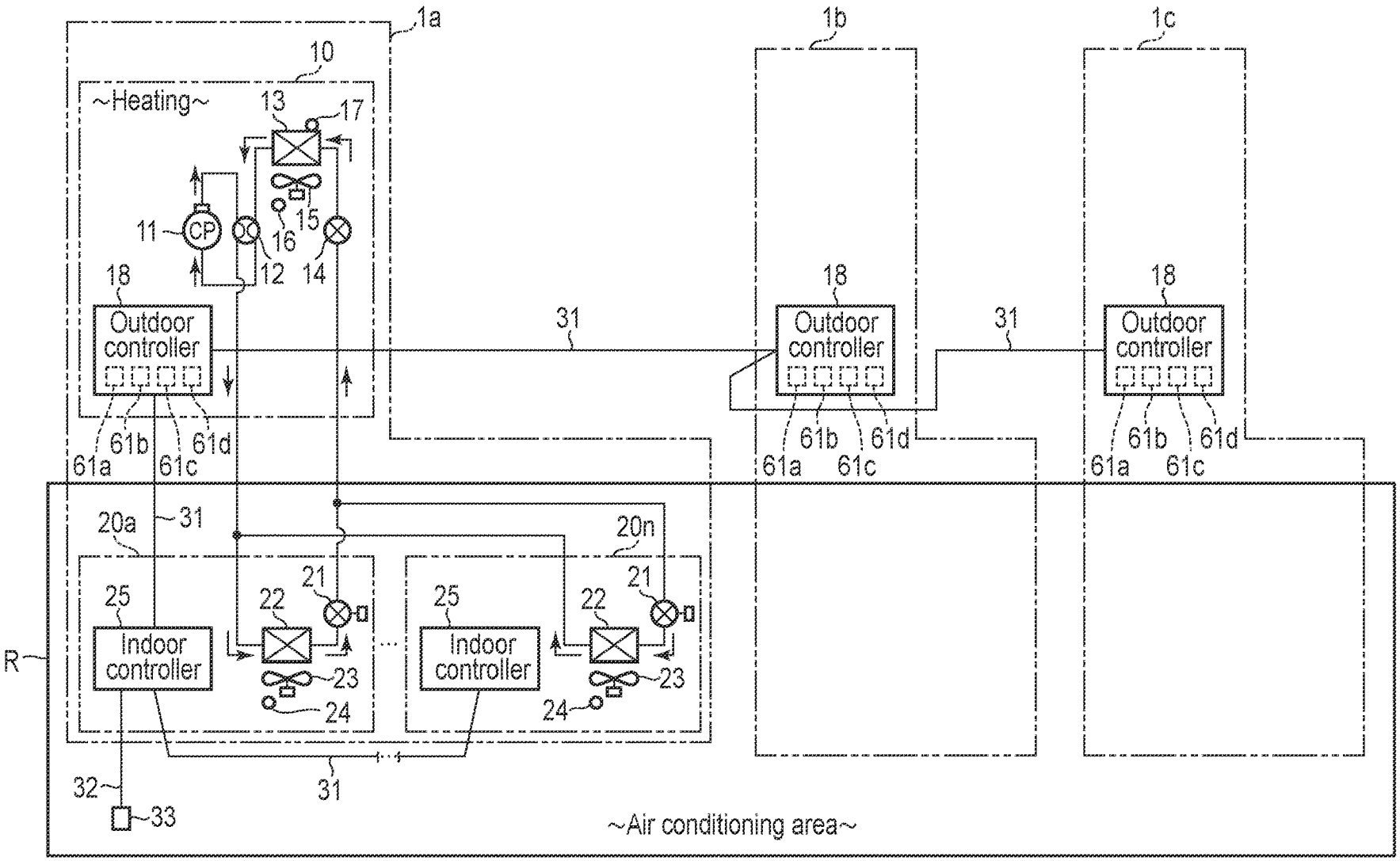
FIG. 4 illustrates the structure of a second embodiment.

As in FIG. 4, a plurality of, for example, three air conditioners 1*a*, 1*b*, and 1*c* of an air conditioning apparatus are placed in the same air conditioning area R. The air conditioners 1*a* and 1*b* are structured the same as those of the first embodiment, and the air conditioner 1*c* is structured the same as the air conditioners 1*a* and 1*b*.

Outdoor controllers 18 of the outdoor units 10 of the air conditioners 1*a*, 1*b*, and 1*c* are connected to each other through a control and data transfer bus line 31. The outdoor controllers 18 of the air conditioners 1*a*, 1*b*, and 1*c* communicate with each other through the bus line 31 to execute the defrosting operation in cooperation. That is, if the times when the starting condition for defrosting is met are chronologically close to each other between the outdoor controllers 18 of the conditioners 1*a*, 1*b*, and 1*c*, that is, specifically, if the times when the starting condition for defrosting therebetween is met are so close to be within a range of a certain time 2·Δt, the air conditioner whose starting condition for defrosting is earliest immediately executes the defrosting operation without waiting for the time when the starting condition for defrosting thereof is met. Note that, if the times when the starting condition for defrosting is met are the same between two or three air conditioners, the outdoor controllers 18 orderly execute the defrosting operation from the one of the air conditioner which has preliminarily been prioritized higher to the subsequent ones without waiting for the time when the starting condition for defrosting thereof is met. The certain time 2·Δt is twice the certain tie Δt of the first embodiment.

In order to achieve the above controlling, each of the outdoor controllers 18 of the air conditioners 1*a*, 1*b*, and 1*c* includes the following control section (first to fourth control means) 61*a* to 61*d* as main functions thereof.

The control section 61*a* sends, if a continuation time t of the heating operation reaches a setting time which is before a predetermined time ta, which is the required element for the starting condition for defrosting, by a certain time 2·Δt (=ta−2·Δt), pre-defrosting signals (first and second pre-defrosting signals) X1 and X2 of continuous logic "1" indicating that the starting condition for defrosting is soon to be met in the air conditioner to all of the other air conditioners until a time when the starting condition for defrosting of the air conditioner is met (=certain time 2·Δt). The pre-defrosting signal X1 is a signal to become logic "1" in the first half of the certain time 2·Δt, and the pre-defrosting signal X2 is a signal to become logic "1" in the latter half of the certain time 2·Δt.

The control section 61*b* monitors, in a period from when the sending of the pre-defrosting signal X1 is started until the starting condition for defrosting of the air conditioner is met (=certain time 2·Δt), if a first priority condition in which rising parts of pre-defrosting signals X1 of all of other air conditioners are received is met, and if the first priority condition is met, immediately preferentially executes the defrosting operation of the air conditioner without waiting for the time when the starting condition for defrosting of the air conditioner is met, and then notifies the prioritized execution to the all of the other air conditioners. Note that, the first priority condition will also be met if the time to start the sending of the pre-defrosting signal X1 and the time to receive the rising parts of the pre-defrosting signals X1 from all of the other air conditioners are the same. In that case, if the priority of the air conditioner is higher than that of all of the other air conditioners, the control section 61*b* immediately preferentially executes the defrosting operation of the air conditioner without waiting for the time when the starting condition for defrosting thereof is met, and notifies the prioritized execution to all of the other air conditioners.

If the above notification is received while the first priority condition is not met, the control section 61*c* monitors if a second priority condition in which a rising part of the pre-defrosting signal X2 is received from another air conditioner is met during a period when the sending of the pre-defrosting signal X2 is started until the starting condition for defrosting of the air conditioner is met (=a certain time Δt), and immediately preferentially executes the defrosting operation of the air conditioner without waiting for the time when the starting condition for defrosting of the air conditioner is met.

If the above notification is not received while the first priority condition is not met, the control section 61*d* executes the defrosting operation of the air conditioner if the starting condition for defrosting of the air conditioner is met.

Figure 5:
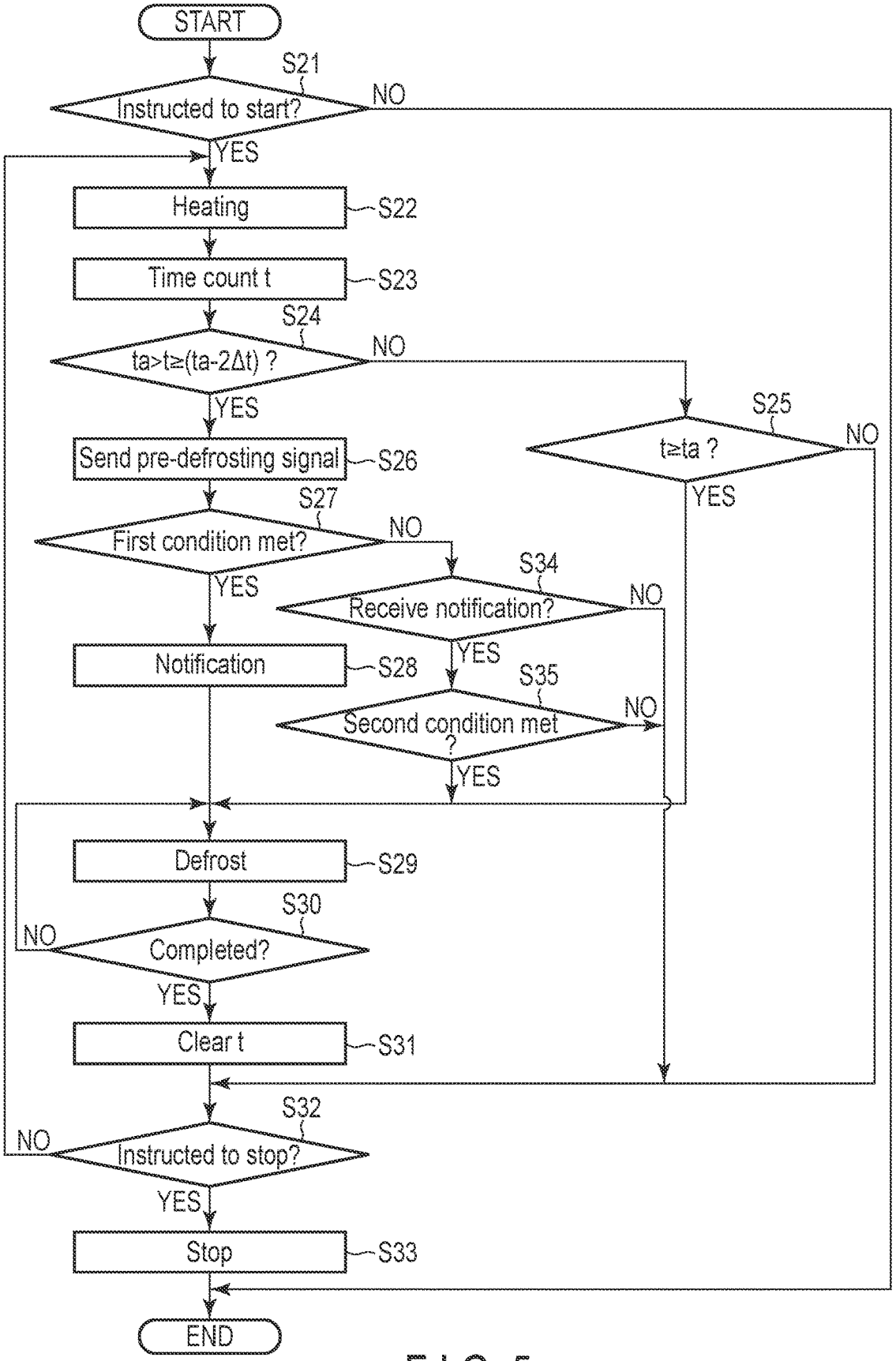
FIG. 5 is a flowchart of controlling of each air conditioner of the second embodiment.

Now, the control executed by each outdoor controller 18 of the air conditioners 1*a*, 1*b*, and 1*c* will be explained as the controlling of the air conditioners 1*a*, 1*b*, and 1*c* with reference to flowchart of FIG. 5 and time chart FIG. 6.

If the heating operation is started by the remote controller 33 (YES in S21), the air conditioners 1*a*, 1*b*, and 1*c* execute the heating operation (S22), and execute a time count t to measure a continuation time t of each heating operation (S23). Then, the air conditioners 1*a*, 1*b*, and 1*c* determine whether or not the time count t is within a range which is equal to or greater than a setting time (=ta−Δt) and below a predetermined time to (S24). If the result of determination is denied (NO in S24), the air conditioners 1*a*, 1*b*, and 1*c* determine whether or not the time count t is equal to or greater than the predetermined time to (S25). If the result of determination is denied (NO in S25), the air conditioners 1*a*, 1*b*, and 1*c* transit to determination of stop instruction in S32 performed later.

If the time count t reaches the setting time (=ta−2·Δt) (YES in S24), the air conditioners 1*a*, 1*b*, and 1*c* send pre-defrosting signals X1 and X2 of logic "1" indicating that the starting condition for defrosting is soon to be met during a certain time 2·Δt until the starting condition for defrosting of the air conditioner is met to the other two air conditioners (S26). Then, the air conditioners 1*a*, 1*b*, and 1*c* start the sending of the pre-defrosting signal X, and then, monitor if a first priority condition to receive a rising part of the pre-defrosting signal X1 from all of the other two air conditioners is met during the certain time 2·Δt when the sending of the pre-defrosting signal X1 is started until the starting condition for defrosting of the air conditioner is met (S27).

Figure 6:
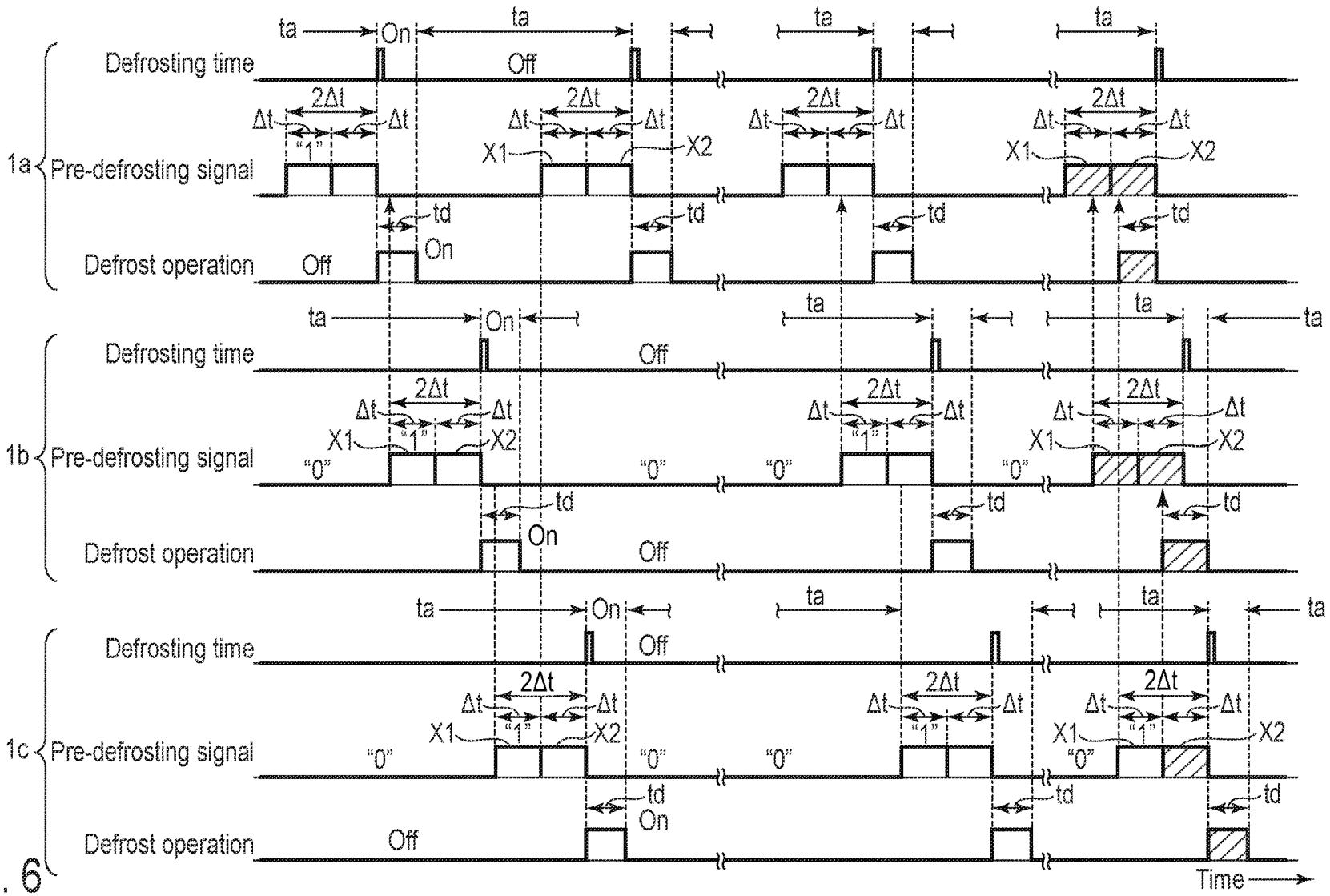
FIG. 6 is a time chart of operation of each air conditioner of the second embodiment.

In FIG. 6, the first time when the starting condition for defrosting of the air conditioner 1*a* is met (defrost time "ON") is earlier than the first time when the starting condition for defrosting of the air conditioner 1*b* is met, and the first time when the starting condition for defrosting of the air conditioner 1*b* is met is earlier than the first time when the starting condition for defrosting of the air conditioner 1*c* is met. A time difference between each of these first times is greater than a certain time 2·Δt.

In that case, the rising parts of the pre-defrosting signals X1 sent from the air conditioners 1*b* and 1*c* do not overlap with the pre-defrosting signals X1 and X2 sent from the air conditioner 1*a*, and thus, the first priority condition is not met (NO in S27).

If the first priority condition is not met (NO in S27), the air conditioner 1*a* monitors if notification of prioritized execution is received from the air conditioner 1*b* or the air conditioner 1*c* after sending the pre-defrosting signal X1 (S34). If the first priority condition is not met (NO in S27), and notification of prioritized execution is not received (NO in S34), the air conditioner 1*a* transits to the determination of stop instruction in S32 performed later.

In FIG. 6, the fourth time when the starting condition for defrosting of the air conditioner 1*a* is met and the fourth time when the starting condition for defrosting of the air conditioner 1*b* have a time difference which is below a certain time 2·Δt. The fourth time when the starting condition for defrosting of the air conditioner 1*b* and the fourth time when the starting condition for defrosting of the air conditioner 1*c* have a time difference which is below a certain time 2·Δt.

In that case, the rising parts of the pre-defrosting signal (hatched in the figure) X1 sent from the air conditioners 1*b* and 1*c* both overlap with the pre-defrosting signals (hatched in the figure) X1 and X2 sent from the air conditioner 1*a*, and the first priority condition is met in the air conditioner 1*a* (YES in S27).

If the first priority condition is met (YES in S27), the air conditioner 1*a* notifies that the defrosting operation is executed with priority to the air conditioners 1*b* and 1*c* (S28), and immediately executes the defrosting operation with respect to the outdoor heat exchanger 13 without waiting for the time when the starting condition for defrosting of the air conditioner 1*a* is met (S29). In accordance with the prioritized execution, the air conditioner 1*a* monitors if the defrosting of the outdoor heat exchanger 13 has been completed based on, for example, a detection temperature Te of the heat exchange temperature sensor 17 (S30). If the defrosting is not completed (NO in S30), the air conditioner 1*a* returns to S29 to continue the defrosting operation (S29).

If the defrosting is completed (YES in S30), the air conditioner 1*a* clears the time count t (S31), and transits to determination of stop instruction in S32. If stop is not instructed (NO in S32), the air conditioner 1*a* returns to S22 to restart heating instead of defrosting (to end the defrosting operation), and the time count t restarts from zero (S23). If stop is instructed (YES in S32), the air conditioner 1*a* stops all operations (S33).

In accordance with the starting of the prioritized execution of the defrosting operation in the air conditioner 1*a*, the first priority condition is not met in the air conditioners 1*b* and 1*c* (NO in S27), and the notification of the prioritized execution from the air conditioner 1*a* enters the air conditioners 1*b* and 1*c* (YES in S34).

If the notification of prioritized execution is received from the air conditioner 1*a* while the first priority condition is not met (NO in S27, YES in S34), the air conditioner 1*b* checks if a second priority condition to receive a rising part of the pre-defrosting signal X2 from the air conditioner 1*c* during a certain time Δt from when the sending of the pre-defrosting signal X2 is started until the starting condition for defrosting in the air conditioner 1*b* is met (S35). Similarly, if the notification of the prioritized execution is received from the air conditioner 1*a* while the first priority condition is not met (NO in S27, YES in S34), the air conditioner 1*c* checks if a second priority condition to receive a rising part of the pre-defrosting signal X2 from the air conditioner 1*b* during a certain time Δt from when the sending of the pre-defrosting signal X2 is started until the starting condition for defrosting in the air conditioner 1*c* is met (S35).

In the time chart of FIG. 6, the rising part of the pre-defrosting signal (hatched in the figure) X2 sent from the air conditioner 1*c* overlaps with the pre-defrosting signal (hatched in the figure) X2 sent from the air conditioner 1*b*, and thus, a second priority condition is met in the air conditioner 1*b* (YES in S35).

If the second priority condition is met (YES in S35), the air conditioner 1*b* immediately executes the defrosting operation with respect to the outdoor heat exchanger 13 without waiting for the time when the starting condition for defrosting of the air conditioner 1*b* is met (S29). Since the defrosting operation of the air conditioner 1*a* has already been completed before the above defrosting operation, the times when the defrosting operation is performed between the air conditioners 1*a* and 1*b* do not overlap with each other.

In accordance with the prioritized execution, the air conditioner 1*b* monitors if the defrosting of the outdoor heat exchanger 13 has been completed based on, for example, a detection temperature Te of the heat exchange temperature sensor 17 (S30). If the defrosting is not completed (NO in S30), the air conditioner 1*b* returns to S22 to continue the defrosting operation (S22).

If the defrosting is completed (YES in S30), the air conditioner 1*b* clears the time count t (S31), and transits to determination of stop instruction in S32. If stop is not instructed (NO in S32), the air conditioner 1*b* returns to S22 to restart heating instead of defrosting (to end the defrosting operation), and the time count t restarts from zero (S23). If stop is instructed (YES in S32), the air conditioner 1*b* stops all operations (S33).

In the remaining air conditioner 1*c*, as with the air conditioner 1*b*, the notification of prioritized execution is received from the air conditioner 1*a* while the first priority condition is not met (NO in S27, YES in S34), and a second priority condition to receive a rising part of the pre-defrosting signal X2 from the air conditioner 1*a* or 1*b* during a period from when the sending of the pre-defrosting signal X2 is started until the starting condition for defrosting in the air conditioner 1*b* is met (=a certain time Δt) (NO in S35). If stop is not instructed in the air conditioner 1*c* (NO in S32), the time count t reaches the predetermined time ta, and the starting condition for defrosting of the air conditioner 1*c* is met (NO in S24, YES in S25). The air conditioner 1*c* executes the defrosting operation when the starting condition for defrosting is met (S29). Since the defrosting operation of the air conditioners 1*a* and 1*b* has already been completed before the above defrosting operation, the times when the defrosting operation is performed between the air conditioners 1*a*, 1*b*, and 1*c* do not overlap with each other.

In a case where the air conditioners 1*a*, 1*b*, and 1*c* are to perform air conditioning of the same air conditioning area R, when at least two of the defrosting operations of the air conditioners 1*a*, 1*b*, and 1*c* overlap with each other, the heating operation of each air conditioner is stopped, and the room temperature of the air conditioning area R is greatly decreased, and residents will be displeased.

In contrast, in the present embodiment, if the times when the starting condition for defrosting is met in the air conditioners 1*a*, 1*b*, and 1*c* are close to each other within the range of a certain time 2·Δt, the defrosting operation of the air conditioner whose starting condition for defrosting is met earliest is performed as the first priority, and after the completion of the defrosting operation of the first priority, the defrosting operation of one of the other air conditioners, whose starting condition for defrosting is met earlier is performed as the second priority. Since the defrosting operation of the remaining one air conditioner is performed after the completion of the defrosting operation of the second priority if the starting condition for defrosting of the remaining air conditioner is met, a time when the heating is stopped between the air conditioners 1*a*, 1*b*, and 1*c* because of each defrosting operation does not overlap with each other. Therefore, a decreased of room temperature in the air conditioning area R can be suppressed.

Furthermore, in the present embodiment, if the times when the starting condition for defrosting is met in two of the air conditioners 1*a*, 1*b*, and 1*c*, for example, of the air conditioners 1*a* and 1*b* are close to each other within the range of a certain time 2·Δt, the defrosting operation of the air conditioner whose starting condition for defrosting is met earlier is immediately performed as the first priority, and after the completion of the defrosting operation of the first priority, the defrosting operation of the remaining air conditioner 1*b* is executed if the starting condition of defrosting thereof is met. Thus, a time when the heating is stopped between the air conditioners 1*a* and 1*b* because of each defrosting operation does not overlap with each other. Therefore, a decreased of room temperature in the air conditioning area R can be suppressed.

[3] Third Embodiment of Present Application

As with the first embodiment, two air conditioners 1*a* and 1*b* are placed in the same air conditioning area R. The air conditioners 1*a* and 1*b* are structured the same as those of the first embodiment, illustrated in FIG. 1.

Outdoor controllers 18 of the air conditioners 1*a* and 1*b* each store the starting condition for defrosting with respect to the outdoor heat exchanger 13 in an internal memory, and if the starting condition for defrosting is met during the heating operation, each execute the defrosting operation with respect to the outdoor heat exchanger 13. The starting condition for defrosting is met if a frost amount H of the outdoor heat exchanger 13 reaches a predetermined amount H2. The outdoor controller 18 of each of the air conditioners 1*a* and 1*b* detects the frost amount H of the outdoor heat exchanger 13 based on, for example, a detection temperature Te of the heat exchange temperature sensor 17.

If the times when the starting condition for defrosting is met are chronologically close to each other between the outdoor controllers 18 of the conditioners 1*a* and 1*b*, that is, specifically, if the times when the starting condition for defrosting therebetween is met are so close to be within a range of a certain time Δtm, the air conditioner whose starting condition for defrosting is earlier preferentially executes the defrosting operation without waiting for the time when the starting condition for defrosting thereof is met. Note that, if the times when the starting condition for defrosting is met are the same, each of the outdoor controllers 18 of the air conditioners 1*a* and 1*b* preferentially executes the defrosting operation of the air conditioner which has preliminarily been prioritized higher without waiting for the time when the starting condition for defrosting thereof is met.

In order to achieve the above controlling, each of the outdoor controllers 18 of the air conditioners 1*a* and 1*b* includes the following control section (first to third control means) 51*a* to 51*c* as main functions thereof.

The control section 51*a* sends, if the frost amount H of the outdoor heat exchanger 13 reaches a set amount H1 which is less than the predetermined amount H2 by a certain amount ΔH (=H2−ΔH), a pre-defrosting signal X of logic "1" indicating that the starting condition for defrosting is soon to be met in the air conditioner to other air conditioners. A certain time Δtm starting from a time when the frost amount H of the outdoor heat exchanger 13 reaches the set amount H1 (=H2−ΔH) until reaching the predetermine amount H2 is equal to or greater than a time td required for the defrosting operation of the air conditioner. A value of the certain amount ΔH is determined such that the certain time Δtm can be sufficiently secured. The time td required for the defrosting operation is a time when the defrosting operation is completed in any environment, and a suitable time which has been calculated based on experiments and the like is selected.

The control section 51*b* immediately executes, if a priority condition to receive a rising part of the pre-defrosting signal X from the other air conditioners during a period from when the sending of the pre-defrosting signal X is started until the starting condition for defrosting is met is met, the defrosting operation of the air conditioner without waiting for a time when the starting condition for defrosting of the air conditioner is met, and send notification of the prioritized execution to the other air conditioners. Note that, if the time to start the sending of the pre-defrosting signal X and the time to receive a rising part of the pre-defrosting signal X sent from other air conditioners are the same, the control section 51*b* immediately preferentially executes the defrosting operation of the air conditioner without waiting for the time when the starting condition for defrosting of the air conditioner is met if the priority of the air conditioner is higher than that of the other air conditioners, and send notification of the prioritized execution to the other air conditioners.

The control section 51*c* decreases, if the notification is received from the other air conditioner while the priority condition is not met, drive frequency F of the compressor 11 by predetermined frequency ΔF to decrease the heating performance of the air conditioner to an extent which is slightly below a value corresponding to a total required performance of each indoor controller 25 in order to suppress the progression of frosting to the outdoor heat exchanger 13, and also executes the defrosting operation of the air conditioner if the starting condition for defrosting of the air conditioner is met.

Figure 7:
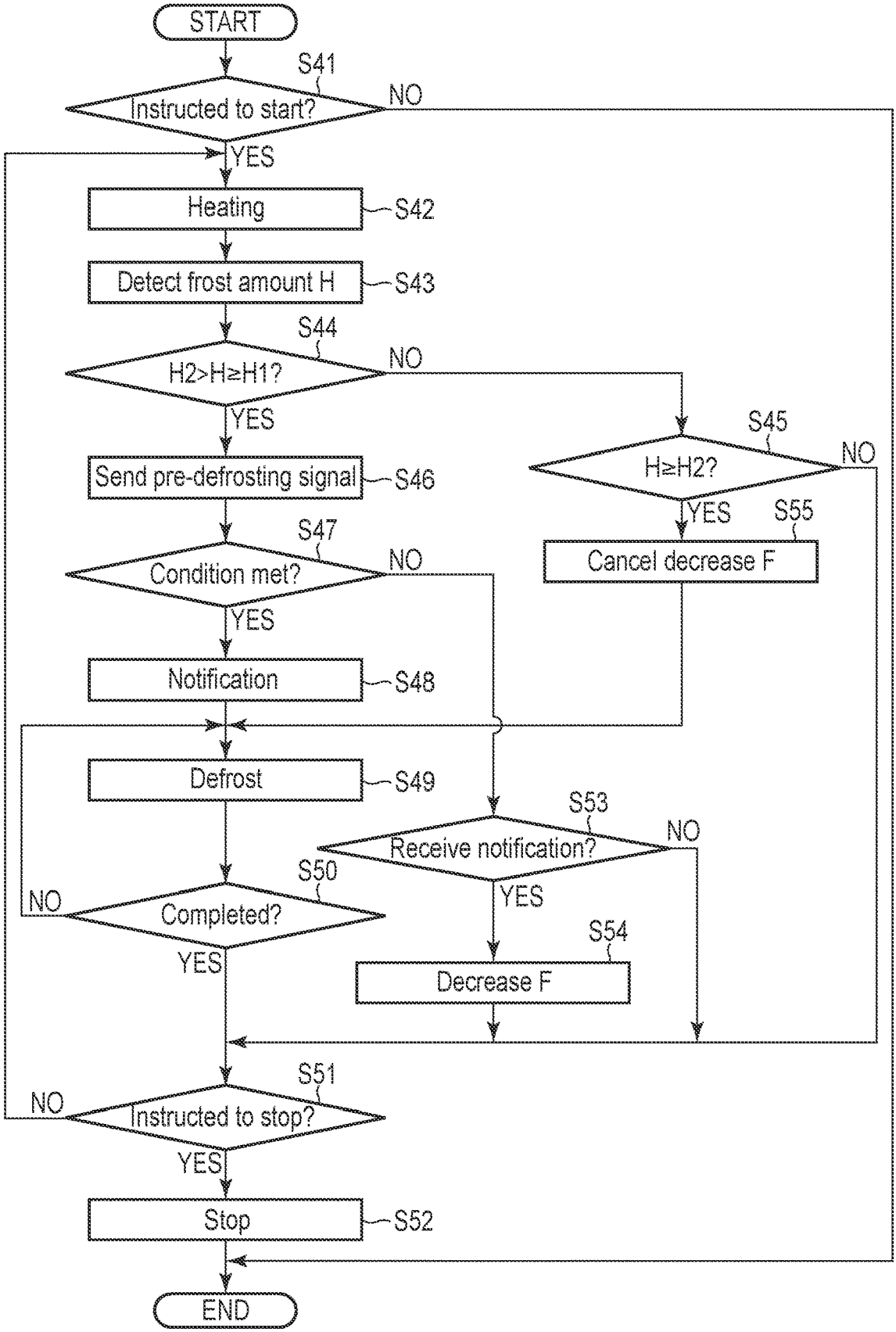
FIG. 7 is a flowchart of controlling of each air conditioner of a third embodiment.

Now, the control executed by each outdoor controller 18 of the air conditioners 1*a* and 1*b* will be explained as the controlling of the air conditioners 1*a* and 1*b*, with reference to flowchart of FIG. 7 and time chart FIG. 8.

If the heating operation is started by the remote controller 33 (YES in S41), the air conditioners 1*a* and 1*b* start the heating operation (S42), and detect a frost amount H of each outdoor heat exchanger 13 (S43). Then, the air conditioners 1*a* and 1*b* determine whether or not the frost amount H is within a range which is equal to or greater than a set amount H1 and below a predetermined amount H2 (S44). If the result of determination is denied (NO in S44), the air conditioners 1*a* and 1*b* determine whether or not the frost amount H is equal to or greater than the predetermined amount H2 (S45). If the result of determination is denied (NO in S45), the air conditioners 1*a* and 1*b* transit to determination of stop instruction in S51 performed later.

If the frost amount H reaches the set amount (YES in S44), the air conditioners 1*a* and 1*b* send a pre-defrosting signal X of logic "1" indicating that the starting condition for defrosting is soon to be met during a period until the frost amount H reaches the predetermined amount H2 to the other air conditioner (S46). Then, the air conditioners 1*a* and 1*b* monitor if a priority condition to receive a rising part of the pre-defrosting signal X from the other air conditioner during a period from when the sending of the pre-defrosting signal X is started until the frost amount H reaches the predetermined amount H2 is met (S47). If the priority condition is not met (NO in S47), the air conditioners 1*a* and 1*b* transit to determination of stop instruction in S11 performed later.

Figure 8:
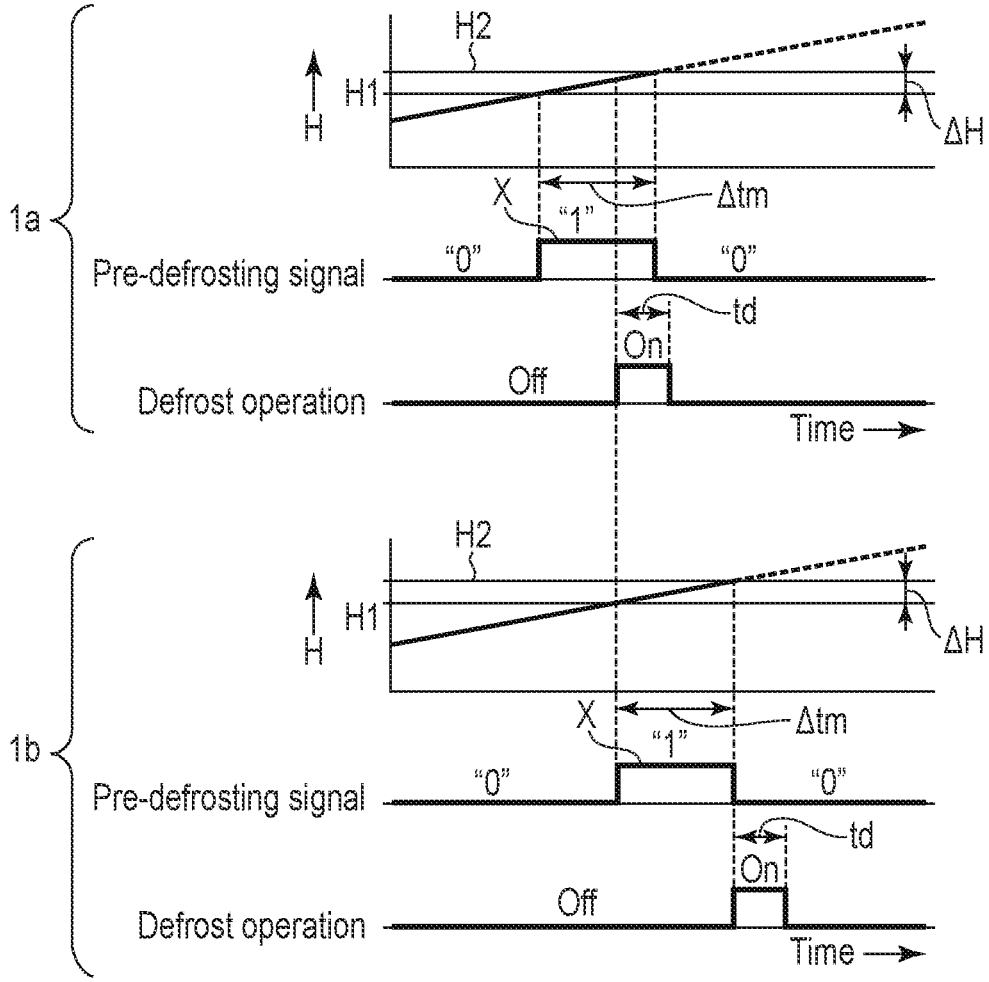
FIG. 8 is a time chart of operation of each air conditioner of the third embodiment.

In FIG. 8, the time when the starting condition for defrosting of the air conditioner 1*a* is met is earlier than the time when the starting condition for defrosting of the air conditioner 1*b* is met, and the rising part of the pre-defrosting signal X sent from the air conditioner 1*b* overlaps with the pre-defrosting signal X sent from the air conditioner 1*a*. In that case, the priority condition is met (YES in S47).

If the priority condition is met (YES in S47), the air conditioner 1*a* sends notification of prioritized execution of the defrosting operation to the air conditioner 1*b*, and immediately preferentially executes the defrosting operation with respect to the outdoor heat exchanger 13 without waiting for the time when the starting condition for defrosting of the air conditioner 1*a* is met (S49). In accordance with the prioritized execution, the air conditioner 1*a* monitors completion of defrosting where the frost amount H becomes below the set amount H1 (S50). If the defrosting is not completed (NO in S50), the air conditioner 1*a* returns to S49 to continue the defrosting operation (S49).

If the defrosting is completed (YES in S50), the air conditioner 1*a* transits to determination of stop instruction in S51. If stop is not instructed (NO in S51), the air conditioner 1*a* returns to S42 to restart heating (to end the defrosting operation). If stop is instructed (YES in S51), the air conditioner 1*a* stops all operations (S52).

While the air conditioner 1*a* is executing the defrosting operation, the priority condition is not met in the air conditioner 1*b* (NO in S47). The air conditioner 1*b* monitors if the notification of prioritized execution is received from the air conditioner 1*a* after the sending of the pre-defrosting signal X (S53). If the priority condition is not met (NO in S47), and the notification of prioritized execution is not received (NO in S53), the air conditioner 1*b* transits to the determination of stop instruction in S51.

In FIG. 8, a time difference between the time when the starting condition for defrosting of the air conditioner 1*a* is met and the time when the starting condition for defrosting of the air conditioner 1*b* is met is small. In that case, the rising part of the pre-defrosting signal X sent from the air conditioner 1*b* overlaps with the pre-defrosting signal X sent from the air conditioner 1*a*, and the priority condition is met in the air conditioner 1*a* (YES in S47).

If the priority condition is met (YES in S47), the air conditioner 1*a* sends notification of prioritized execution of the defrosting operation to the air conditioner 1*b* (S48), and immediately executes the defrosting operation with respect to the outdoor heat exchanger 13 without waiting for the time when the starting condition for defrosting of the air conditioner 1*a* is met (S49). In accordance with the prioritized execution, the air conditioner 1*a* monitors if the defrosting is completed based on a detection temperature Te of the heat exchange temperature sensor 17, for example (S50). If the defrosting is not completed (NO in S50), the air conditioner 1*a* returns to S49 to continue the defrosting operation (S49).

If the defrosting is completed (YES in S50), the air conditioner 1*a* transits to determination of stop instruction in S51. If stop is not instructed (NO in S51), the air conditioner 1*a* returns to S42 to restart heating instead of the defrosting (to end the defrosting operation), and detects the frost amount H of the outdoor heat exchanger 13. If stop is instructed (YES in S51), the air conditioner 1*a* stops all operations (S52).

In accordance with the starting of the prioritized execution of the defrosting operation in the air conditioner 1*a*, the priority condition is not met in the air conditioner 1*b* (NO in S47), and the notification of the prioritized execution from the air conditioner 1*a* enters the air conditioner 1*b* (YES in S53).

The air conditioner 1*b* decreases, if the notification of prioritized execution is received from the air conditioner 1*a* while the priority condition is not met (NO in S47, YES in S53), drive frequency F of the compressor 11 by predetermined frequency ΔF (S54) to decrease the heating performance of the air conditioner 1*b* to an extent which is slightly below a value corresponding to a total required performance of each indoor controller 25. Because of the decrease, the progression of frosting to the outdoor heat exchanger 13 can be slowed, and thus, the time when the starting condition for defrosting of the air conditioner 1*b* is met can be delayed.

If stop is not instructed in the air conditioner 1*b* (NO in S51), then, the frost amount H reaches the predetermined amount H2, and the starting condition for defrosting of the air conditioner 1*b* is met (NO in S44, YES in S45). The air conditioner 1*b* cancels the decrease of the drive frequency F when the starting condition for defrosting is met (S55), and executes the defrosting operation (S48). In the execution of the defrosting operation, the delay of defrosting because of the decrease of the heating performance will be taken into consideration, and thus, the defrosting operation of the air conditioner 1*a* has already been ended. Thus, the times to perform the defrosting operation do not overlap with each other between the air conditioners 1*a* and 1*b*. Since the stop of the heating because of the defrosting operation does not overlap with each other between the air conditioners 1*a* and 1*b*, the decrease of room temperature in the air conditioning area R can be suppressed.

[Variant]

In the above embodiments, elements to satisfy the starting condition for defrosting are the continuation time t of the heating operation, and the frost amount H of the outdoor heat exchanger 13; however, an outside air temperature To detected by the outdoor temperature sensor 16 may be added thereto.

In the above embodiments, each air conditioner includes one outdoor unit 10; however, a case where each air conditioner includes a plurality of outdoor units 10 will be encompassed therein. In that case, one of multiple outdoor units 10 of the air conditioner 1*a* becomes a master unit while the others become subunits, and the outdoor controller 18 of the master unit is connected to the indoor controller 25 of the indoor unit 20*a* through the bus line 31. In the air conditioner 1*b*, one of the multiple outdoor units 10 becomes a master unit while the others become subunits, and the outdoor controller 18 of the master unit is connected to the indoor controller 25 of the indoor unit 20*a* through the bus line 31.

While certain embodiments and variant have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An air conditioning apparatus comprising:

a plurality of air conditioners with a heat pump refrigeration cycle in which a compressor, a four-way valve, an outdoor heat exchanger, an expansion valve, and an indoor heat exchanger are connected, the air conditioners configured to execute a heating operation and in the heating operation execute a defrosting operation with respect to the outdoor heat exchanger if a condition for defrosting is met; and controller which controls the air conditioners, wherein the condition for defrosting is met if a continuation time t of the heating operation reaches a predetermined time ta, and the controller includes:

first control section provided with each air conditioner to send, if the continuation time t reaches a setting time (=ta−Δt) before the predetermined time ta by a certain time Δt, a pre-defrosting signal indicating that the condition for defrosting is soon to be met to other air conditioners;

second control section provided with each air conditioner to execute, if the pre-defrosting signal is received from all of the air conditioners during a period after the pre-defrosting signal is sent and until the condition for defrosting of the air conditioner is met, the defrosting operation of the air conditioner without waiting for the time when the condition for defrosting of the air conditioner is met; and third control section provided with each air conditioner to execute, if the pre-defrosting signal is not received from all of the air conditioners during a period after the pre-defrosting signal is sent and until the condition for defrosting of the air conditioner is met, the defrosting operation of the air conditioner if the condition for defrosting of the air conditioner is met.

2. The air conditioning apparatus of claim 1, wherein the air conditioners are at least three air conditioners, and the starting condition for defrosting is met if a continuation time t of a heating operation reaches a predetermined time ta, and the controller includes;

first control section provided with each air conditioner to send, if the continuation time t reaches a setting time before the predetermined time ta by a certain time 2·Δt (=ta−2·Δt), first and second pre-defrosting signals indicating that the starting condition for defrosting is soon met to other air conditioners;

second control section provided with each air conditioner to execute, if a first priority condition where the first pre-defrosting signal is received from all of the other air conditioners during a period after the first pre-defrosting signal is sent and until the starting condition for defrosting of the air conditioner is met is met, the defrosting operation of the air conditioner without waiting for the time when the starting condition for defrosting of the air conditioner is met, and to send notification of the execution to all of the other air conditioners;

third control section provided with each air conditioner to execute, if the notification is received while the first priority condition is not met, and if a second priority condition where the second pre-defrosting signal is received from the other air conditioners during a period after the second pre-defrosting signal is sent and until the starting condition for defrosting of the air conditioner is met is met, the defrosting operation of the air conditioner without waiting for the time when the starting condition for defrosting of the air conditioner is met; and fourth control section provided with each air conditioner to execute, if the notification is not received while the first priority condition is not met, the defrosting operation of the air conditioner if the starting condition for defrosting of the air conditioner is met.

3. The air conditioning apparatus of claim 1, wherein the time Δt is equal to or greater than a time required for the defrosting operation of each air conditioner.

4. The air conditioning apparatus of claim 1, wherein the starting condition for defrosting is met if a frost amount H of the outdoor heat exchanger reaches a predetermined amount H2, and the controller includes:

first control section provided with each air conditioner to send, if the frost amount H of the outdoor heat exchanger reaches a set amount H1 which is less than the predetermined amount H2 by a certain amount ΔH, a pre-defrosting signal indicating that the starting condition for defrosting is soon to be met to other air conditioners;

second control section provided with each air conditioner to execute, if the pre-defrosting signal is received from all of the other air conditioners during a period after the pre-defrosting signal is sent and until the starting condition for defrosting of the air conditioner is met, the defrosting operation of the air conditioner immediately without waiting for the time when the starting condition for defrosting of the air conditioner is met; and third control section provided with each air conditioner to execute, if the pre-defrosting signal is not received from all of the other air conditioners during a period after the pre-defrosting signal is sent and until the starting condition for defrosting is met, the defrosting operation of the air conditioner if the starting condition for defrosting of the air conditioner is met.

5. The air conditioning apparatus of claim 4, wherein the second control section executes, if the pre-defrosting signal is received from all of the other air conditioners during a period after the pre-defrosting signal is sent and until the starting condition for defrosting of the air conditioner is met, the defrosting operation of the air conditioner immediately without waiting for the time when the starting condition for defrosting of the air conditioner is met, and sends notification of the execution to the other air conditioners, and the third control section decreases, if the notification is received while the pre-defrosting signal is not received from all of the other air conditioners during a period after the pre-defrosting signal is sent and until the starting condition for defrosting of the air conditioner is met, heating performance of the air conditioner, and executes the defrosting operation of the air conditioner if the starting condition for defrosting of the air conditioner is met.

* * * * *